US010176946B2

(12) United States Patent
Boehm et al.

(10) Patent No.: US 10,176,946 B2
(45) Date of Patent: Jan. 8, 2019

(54) DRIVE DEVICE FOR AN ELECTRIC SWITCHING DEVICE

(71) Applicant: GENERAL ELECTRIC TECHNOLOGY GMBH, Baden (CH)

(72) Inventors: Gerrit Boehm, Baunatal (DE); Achim Stelter, Kassel (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 15/546,428

(22) PCT Filed: Feb. 5, 2016

(86) PCT No.: PCT/EP2016/052527

§ 371 (c)(1),
(2) Date: Jul. 26, 2017

(87) PCT Pub. No.: WO2016/134955

PCT Pub. Date: Sep. 1, 2016

(65) Prior Publication Data

US 2018/0019082 A1 Jan. 18, 2018

(30) Foreign Application Priority Data

Feb. 26, 2015 (DE) ..... 10 2015 203 479

(51) Int. Cl.
*H01H 33/42* (2006.01)
*H01H 3/30* (2006.01)
(Continued)

(52) U.S. Cl.
CPC ..... *H01H 33/42* (2013.01); *H01H 3/3052* (2013.01); *H01H 3/38* (2013.01);
(Continued)

(58) Field of Classification Search
CPC ..... H01H 3/30; H01H 33/42; H01H 33/565; H01H 33/64; H01H 2003/3068; H01H 2003/323; H01H 2235/01
(Continued)

(56) References Cited

U.S. PATENT DOCUMENTS 3,909,676 A 9/1975 Mcconnell
5,932,858 A * 8/1999 Meinherz ..... H01H 33/53 218/84

(Continued)

FOREIGN PATENT DOCUMENTS

DE 9109812 U1 10/1991
EP 2037475 A1 3/2009
WO 2004055850 A1 7/2004

OTHER PUBLICATIONS

Translation of DE9109812 (original document published Oct. 2, 1991).*

(Continued)

*Primary Examiner* — Edwin A. Leon
*Assistant Examiner* — William Bolton
(74) *Attorney, Agent, or Firm* — Bond Schoeneck & King, PLLC; George McGuire

(57) ABSTRACT

The invention relates to a drive device for an electrical switching device, in particular for a high-voltage switch, having a housing which can be filled with insulating gas, having an energy storage device which is arranged in the housing and has a spring and a stop against which the spring can be tensioned. According to the invention, an adjustment device which can be actuated from the exterior of the housing is provided, by means of which adjustment device a position of the stop in the housing can be adjusted along an axis.

17 Claims, 5 Drawing Sheets

Figure 1:
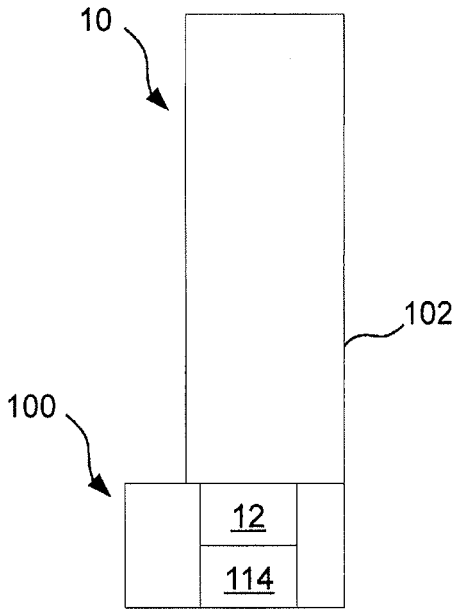

(51) Int. Cl.
*H01H 3/38* (2006.01)
*H01H 3/32* (2006.01)
*H01H 33/56* (2006.01)

(52) U.S. Cl.
CPC ... *H01H 33/565* (2013.01); *H01H 2003/3068* (2013.01); *H01H 2003/323* (2013.01); *H01H 2235/01* (2013.01)

(58) Field of Classification Search
USPC ..... 218/154, 153, 155, 120, 59, 61
See application file for complete search history.

(56) References Cited

U.S. PATENT DOCUMENTS

| | | | | |
|---|---|---|---|---|
| 6,472,627 | B1 | 10/2002 | Yoon | |
| 6,927,356 | B2 * | 8/2005 | Sato | H01H 33/666 218/154 |
| 8,497,446 | B1 * | 7/2013 | Glaser | H01H 33/666 218/136 |
| 2012/0175347 | A1 | 7/2012 | Glaser | |

OTHER PUBLICATIONS

International Search Report and Written Opinion Form PCT/ISA/220, International Application No. PCT/EP2016/052527, pp. 1-9 International Filing Date Feb. 5, 2016, dated May 18, 2016.

* cited by examiner

DRIVE DEVICE FOR AN ELECTRIC SWITCHING DEVICE

CROSS-REFERENCE TO RELATED APPLICATIONS

This application is the United States National Stage Application under 35 U.S.C. 371 of PCT Application No. PCT/EP2016/052527, filed Feb. 5, 2016, which claims priority to German Application No. 10 2015 203 479.8, filed Feb. 26, 2015, the entire disclosure of each of which is incorporated herein by reference.

BACKGROUND OF THE INVENTION

The invention relates to a drive device for an electrical switching device, in particular for a high voltage switch, according to the preamble of claim 1. Such a drive device is known, for example, from DE 9109812.

The known device has the disadvantage that in an operable state no influence can be exerted on the characteristics of the spring of the energy storage device and thus the operating behavior of the energy storage device. In particular, a housing containing the insulating fluid must be opened to influence the spring which first requires an elaborate suctioning-off of the insulating fluid and then, after any maintenance of the spring, a re-filling to restore a ready-to-use state.

Accordingly, it is an object of the present invention to improve a device of the type mentioned above to avoid the aforementioned disadvantages and, in particular, enable the exertion of influence on the operating behavior of the energy storage device without having to open the housing.

According to the invention, this object is achieved by the drive device mentioned above by providing an adjustment device which can be actuated from the exterior of the housing, by means of which a position of the stop in the housing can be adjusted along an axis. This advantageously makes it possible to influence the mechanical energy stored in the spring in the tensioned state by varying the position of the stop. By using the adjustment device according to the invention, especially advantageously, the position of the stop used for tensioning the spring can be adjusted by an actuation of the adjustment device which takes place on the exterior of the housing so that no evacuation of the housing or a refilling with insulating fluid, in particular insulating gas, is required after adjustment. Rather, the housing can be left unopened and filled with insulating fluid for the entire adjustment operation, so that the drive device according to the invention is always ready for operation and is nevertheless flexibly adjustable with regard to the energy stored in the spring. This makes it possible, in particular, to adjust the spring energy and thus the operating behavior of the energy storage device of the switching device in the field during operation of the drive device.

Applying the principle according to the invention, particularly advantageously, a simple adaptation of the operating behavior, in particular of the (switching) behavior of switching devices, in particular of the switching times can take place, which, in addition to the mass system of the chain of action (spring, drive rod(s), shafts, switching contact(s)) of the switching device depend on the energy stored in the spring. For example, the spring of the drive device according to the invention can be used as so-called "Switch-off spring", which thus drives at least one switching contact of an associated switching device in the sense of a switch-off operation. Applying the invention—without having to open the housing of the drive device which usually contains insulating gas—advantageously the switching time can be changed, as a result of which, for example, production tolerances of the springs and other components, age-related drift effects and the like can be compensated in a simple manner. In the case of switching systems with several switching devices and accordingly, several drive devices, which are respectively associated to the individual switching devices, the switching times of all switching devices can be adjusted by means of the adjustment options provided according to the invention, such that, for example, three-phase or multi-phase high-voltage power switches can be provided which have no appreciable deviations in the switching times between the respective phases.

In an embodiment, the housing has an opening, wherein an adjustment element, which can be coupled to the stop, of the adjustment device is arranged movably in the opening, in particular parallel to or along the axis.

In an embodiment, the housing has a guide for the adjustment element in the area of the opening. Particularly preferably, the housing has an internal thread in the area of the opening, wherein the adjustment element has an external thread cooperating with said internal thread. In this way, by screwing the adjustment element in the housing or by unscrewing the adjustment element from the housing the position of the stop serving for the tensioning of the spring and thus the mechanical energy which can be stored in the spring can be varied.

In an embodiment, a sealing element is provided which seals an interior space of the housing against the opening, wherein preferably at least one ring seal and/or one lip seal ring is associated with the sealing element. Alternatively or in addition to the sealing element, in further embodiments, the guide of the adjustment element or the thread of the adjustment element can be configured in such a way that it will have a sealing effect.

In a further embodiment, it is provided that the stop is arranged on an end face of the sealing element facing the interior space, whereby a particularly small-sized configuration is obtained.

In a further embodiment it is provided that the sealing element can be coupled to the adjustment element on its end face facing away from the interior. In a variant, the coupling of the elements can be formed in such a way that (only) compressive forces can be transmitted, assuming that the spring is exerting corresponding compressive forces on the sealing element and thus presses the latter against the adjustment element. In particular, it can also be provided that the sealing element and the adjustment element are not connected to one another in a rotationally fixed manner, so that a rotation thereof resulting possibly during a screwing operation of the adjustment element does not transfer to the sealing element and/or the spring. In particular, this also ensures that a possibly present ring seal is not subjected to rotation.

In a further embodiment it is provided that the sealing element is formed integrally with the adjustment element, as a result of which there is less installation effort.

A particularly simple adjustment of the position of the stop for the spring and thus of the storable energy is obtained according to a further embodiment in which the adjustment element has, on its side facing away from the interior space of the housing, a driving profile, for example a hexagon socket profile or the like.

In a further embodiment it is provided that the housing has a hollow cylindrical section, wherein the adjustment device and/or at least a part of the spring is arranged in the hollow cylindrical section, whereby the drive device is particularly small and possibly no further devices for guiding the spring in the housing are required. Furthermore, the housing in the area of the hollow cylindrical portion can be adapted to the geometry of the spring, thereby making it smaller in this area, for example, than other areas of the housing thus providing further degrees of freedom with respect to the arrangement of the drive device in or on a target system, in particular a high-voltage circuit breaker or a switching system.

In a further embodiment, it is provided that a ratio of an outer diameter of the hollow cylindrical section to an outer diameter of the spring is between about 110 percent and about 200 percent, in particular between about 110 percent and about 150 percent, resulting in a particularly small-sized configuration.

In a further embodiment it is provided that the spring at its end section facing away from said stop is coupled to a first lever arm of a lever rotatably mounted in the housing, in particular by means of a spring plate which is arranged rotatably on said lever. By means of the lever, the spring force can advantageously be transferred to another element of the chain of action of the drive device or the switching device associated therewith.

In a further embodiment it is provided that second lever arm of the lever is coupled to a drive rod for actuating a switching contact of said switching device.

In a further embodiment a secondary sealing element is provided which seals the interior space of the housing against the opening, in particular independently of the sealing element or independently of a state of the sealing element. The secondary sealing element can advantageously be arranged "in series" with the above-mentioned (primary) sealing element and further improve the sealing effect in the area of the opening.

In a further embodiment, a securing element is provided, which is configured for locking said adjustment device, in particular for locking a component of the adjustment device. In this way, an unintentional adjustment of the adjustment device is avoided, as may occur by vibrations and/or temperature changes.

As a further solution to the object of the present invention there is provided a switching system having at least one switching device and at least one drive device according to the invention.

Further features, possible applications and advantages of the invention will become apparent from the description of exemplary embodiments of the invention which are illustrated in the figures of the drawings. All the described or illustrated features form the subject matter of the invention either by themselves or in any combination, independently of their combination in the claims or their referral back and independent of their wording or representation in the description or in the drawing.

Figure 3:
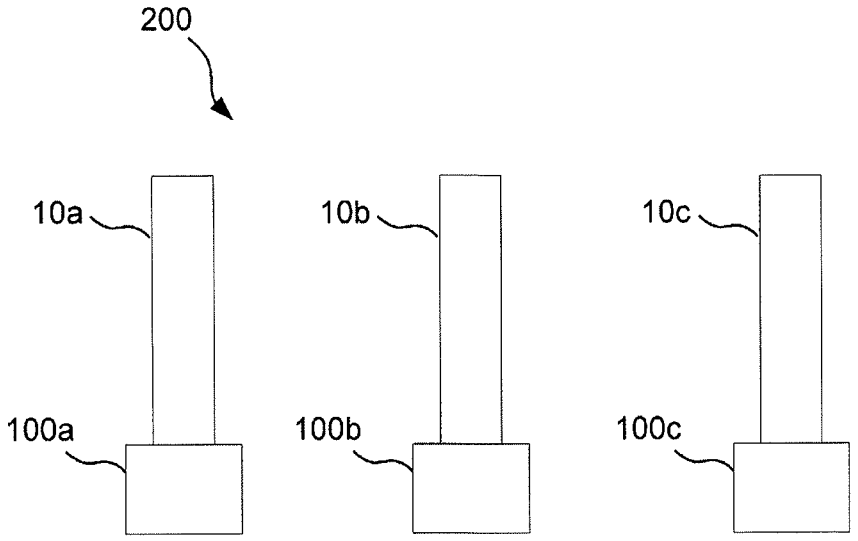
Figure 2A:
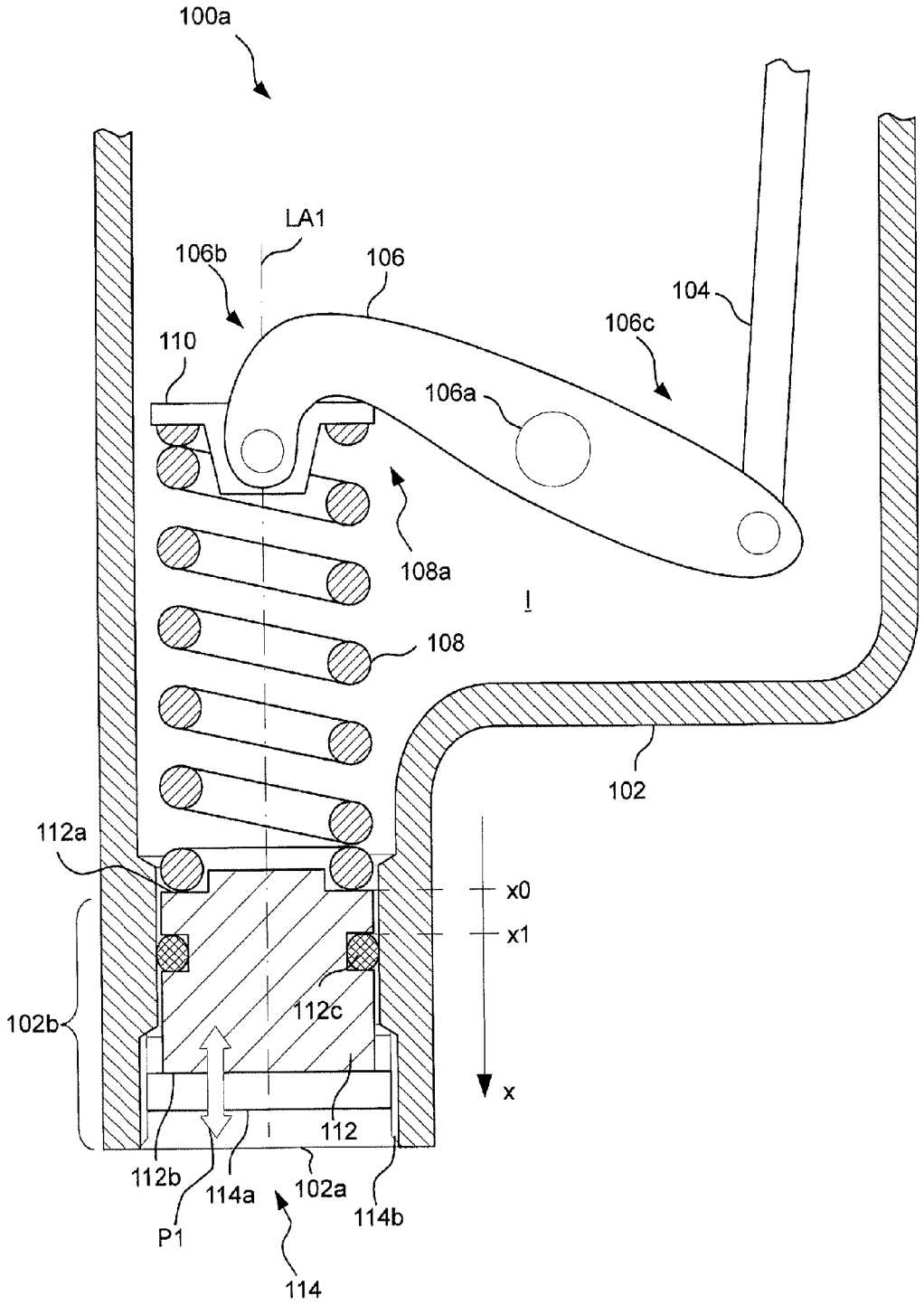
Figure 2B:
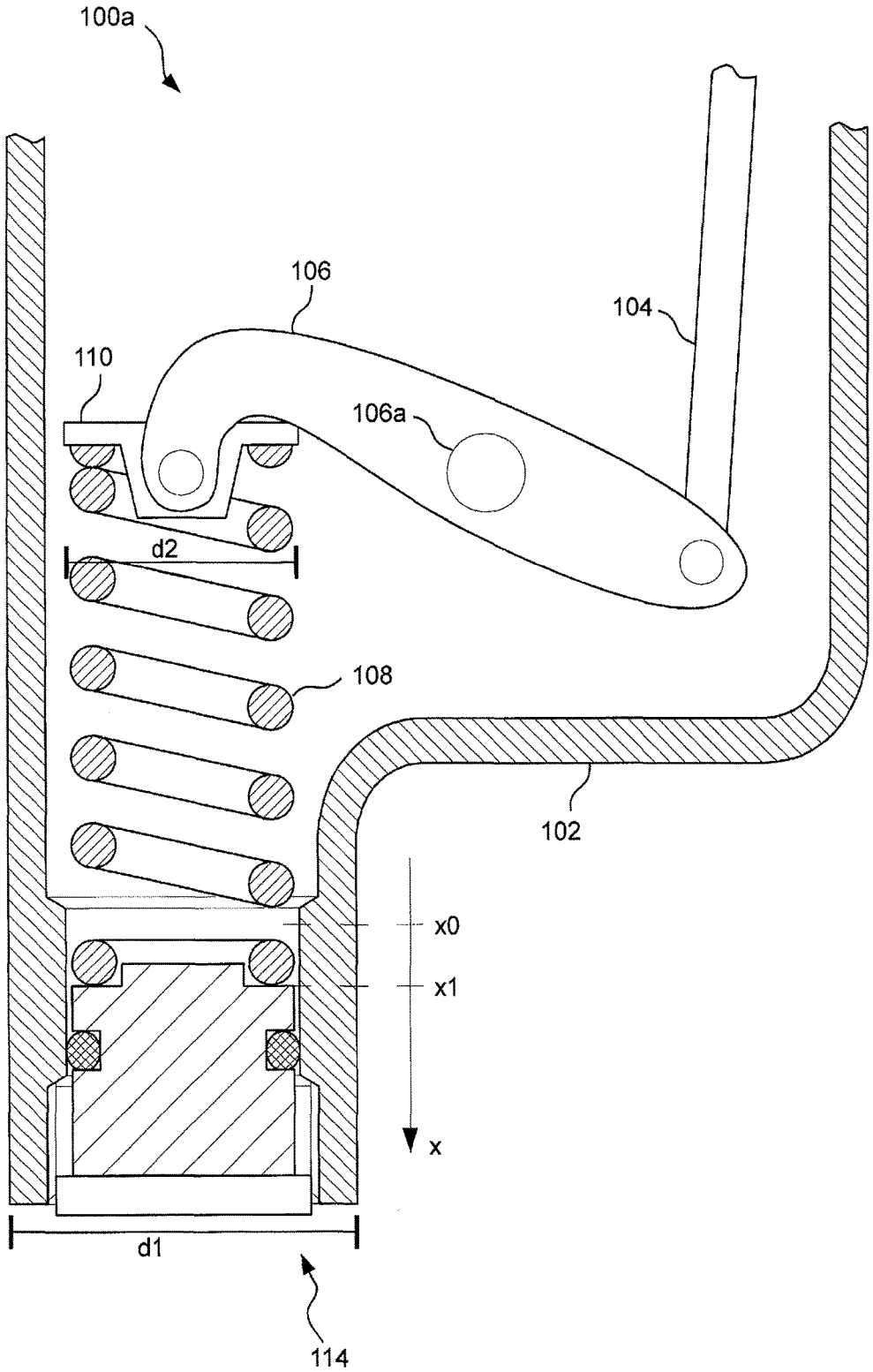

In the drawing:

FIG. 1 shows schematically a first embodiment of the drive device according to the invention, FIG. 2*a* shows schematically a partial cross-section of a second embodiment of the drive device according to the invention in a first operating state, FIG. 2*b* shows schematically a partial cross-section of the second embodiment of the drive device according to the invention in a second operating state, FIG. 3 shows schematically a three-phase switching system according to an embodiment, and

4*a*, 4*b* show further embodiments.

FIG. 1 shows schematically a first embodiment of the drive device 100 according to the invention. Drive device 100 is provided, for example, for driving a switching contact (not shown) of an electrical switching device 10, in particular for a high-voltage switch or a high-voltage circuit breaker, and in an embodiment, for example, can be arranged in a common housing 102 together with switching device 10. An interior space of housing 102 can be filled with an insulating fluid, in particular insulating gas, for example with SF6 (sulfur hexafluoride) and/or CF4 (tetrafluoromethane) and/or CO2 (carbon dioxide) and/or a gas from the group of fluorinated nitriles or mixtures thereof. A particularly preferred insulating fluid is, for example, a mixture of a fluorinated nitrile, which is marketed under the trade name Novec 4710 by the company 3M, with carbon dioxide. Such a mixture is also referred to as "G3" insulating gas.

In a manner known per se, drive device 100 has an energy storage device 12 which stores mechanical energy by means of at least one spring (not shown in FIG. 1) in a tensioned state of the spring.

According to the invention, an adjustment device 114 which can be actuated from the exterior of housing 102 is provided (not shown), by means of which a position of a stop (not shown), against which the spring is tensioned, can be adjusted in the housing along an axis. This allows the level of mechanical energy which can be stored in the spring of the energy storage device 12 and which can be retrieved for switching operations can be simply adjusted from the exterior on drive device 100 without having to open it.

FIG. 2*a* shows schematically a partial cross-section of a second embodiment 100*a* of the drive device according to the invention. As already described with reference to FIG. 1, drive device 100*a*, together with the switching device associated with it, of which only a drive rod 104 is shown in FIG. 2*a*, can be arranged in common housing 102. The interior space I of housing 102 can be filled with an insulating fluid, in particular with an insulating gas such as, e.g., SF6.

In housing 102, a lever 106 is provided, which is rotatably supported on a first shaft 106*a* and has two lever arms 106*b*, 106*c*. Lever 106 is used to transmit the spring force of spring 108, which is also arranged in housing 102, to drive rod 104 which, for example, affects a switching contact which is not shown of the switching device associated with drive device 100*a*. For example, spring 108 can be used as a so-called "Switch-off spring", which—starting from a state tensioned against stop 112*a*—drives at least one switching contact of the associated switching device in the sense of a switch-off operation via lever 106 and drive rod 104.

In an embodiment, shaft 106*a* can also be routed to the exterior (not shown) through a housing wall so that torque can be applied to shaft 106*a* from the exterior by further drive components, such as, for example, an electromechanical drive or the like, in order to tension spring 108 (again).

In its end section 108*a* facing lever 106, spring 108 abuts against spring plate 110, as shown in FIG. 2*a*, which, preferably rotatably, is connected to lever arm 106*b* on the left in FIG. 2*a*. As already described, the other end of spring 108 abuts against stop 112*a* in a tensioned manner, which is part of adjustment device 114 according to the invention.

Adjustment device 114 has a substantially disc-shaped adjustment element 114*a*, which is movably arranged in an opening 102*a* of housing 102 along an axis running vertically in FIG. 2*a*, which in the present case corresponds to the longitudinal axis LA1 of spring 108. Adjustment element 114*a* has an external thread which cooperates with an internal thread 114*b* of housing 102 in such a way that adjustment element 114*a* can be screwed in the housing or unscrewed from the housing by rotation about axis LA1 resulting in the axial mobility indicated by block arrow P1. For this purpose, a driving profile, e.g., a common hexagon socket profile or the like may be provided on an exterior end face, i.e. at the bottom in FIG. 2*a*, of adjustment element 114*a*.

Since opening 102*a* of housing 102 in the present case is arranged in a hollow cylindrical portion 102*b* of the housing, this portion 102*b* can advantageously simultaneously at least accommodate and/or guide a part of spring 108 and parts of adjustment device 114.

The adjustment element 114*a* is preferably coupled with a sealing element 112, wherein an interior end face of sealing element 112 advantageously has or forms stop 112*a* for spring 108.

The coupling of sealing element 112 with adjustment device 114 results in axial mobility of components 112, 114 and thus also stop 112*a*, against which spring 108 can be tensioned, so that the spring path of spring 108 and thus also the level of mechanical energy which can be stored in spring 108 by the tensioning of spring 108, can be adjusted in a simple manner by screwing in or unscrewing the adjustment element. As a result, by actuating the adjustment element 114*a* alone from the exterior, i.e., without opening housing 102, manufacturing-related tolerances and/or age-related or temperature-related changes in the spring constant of spring 108 can be compensated, so that precise maintenance of the required switching times of the switching device driven by drive device 100*a* is ensured by simple and cost-effective adjustment of the position of stop 112*a* throughout the life of the device. In particular, gas exchanges of the insulating gas and, in any case, opening/closing of housing 102 can be advantageously avoided.

In the operating state shown in FIG. 2*a*, a contact surface of stop 112*a* abuts against spatial coordinate x0 of the coordinate axis x pointing vertically downwards in FIG. 2*a*. In the operating state shown in FIG. 2*b* the contact surface of stop 112*a* abuts against spatial coordinate x1>x0 of the coordinate axis x, which corresponds to a lower energy which can be stored in spring 108.

In a further embodiment, an end face 112*b* (FIG. 2*a*) of sealing element 112 facing adjustment element 114*a* is detachably or non-detachably connected to the opposing surface of adjustment element 114*a*.

In a further embodiment, the sealing element 112 has at least one circumferential groove, not indicated, in which a ring seal 112*c* is inserted, which seals the interior space I against the surroundings or opening 102*a*. Alternatively or in addition, a shell surface of sealing element 112 and the inner surface of the hollow cylindrical housing portion 102*b* facing the shell surface radially outwardly, can have a high surface quality, in particular low roughness, which can also contribute to the sealing effect. Alternatively or in addition to sealing element 112, in further embodiments, the guide of adjustment element 114 or thread 114*b* of the adjustment element can be configured to have a sealing effect.

In a further embodiment, it is provided that a ratio of an outer diameter d1 (FIG. 2*b*) of the hollow cylindrical portion to an outer diameter d2 of spring 108 is between about 110 percent and about 200 percent, in particular between about 110 percent and about 150 percent, resulting in a particularly small building configuration.

FIG. 3 schematically shows a three-phase switching system 200 according to an embodiment. Switching system 200 has a switching device 10*a*, 10*b*, 10*c* for each phase, which, in each case, is associated with a drive device 100*a*, 100*b*, 100*c* according to the invention. The drive devices 100*b*, 100*c* are advantageously configured in the same way as drive device 100*a* described with reference to FIGS. 2*a*, 2*b*.

Advantageously, the switching times of all three switching devices 10*a*, 10*b*, 10*c* can be adjusted by the adjustment options for the position of stop 112*a* (FIG. 2*a*) provided according to the invention, so that no appreciable differences in the switching times occur between the respective phases.

In a further embodiment (not shown), spring 108 can also be configured as a tension spring and, for example, can also be arranged on second lever arm 106*c* with its first end 108*a* with respect to drive rod 104 (FIG. 2*a*). In this case, the second spring end can be attached to an adjustment element or a corresponding adjustment device configured for connection to the tension spring. Thus, in this embodiment, the first lever arm 106*b* can be omitted and a part of housing 102 which is comparable to portion 102*b*, e.g., in FIG. 2*a* below the mounting point of drive rod 104, can be arranged on lever arm 106*c*. In this case, the pulling force obtainable by the spring would be equally simply adjustable from the exterior by means of the adjustment device as the pretension at exemplary embodiment of FIGS. 2*a*, 2*b*.

Figure 4A:
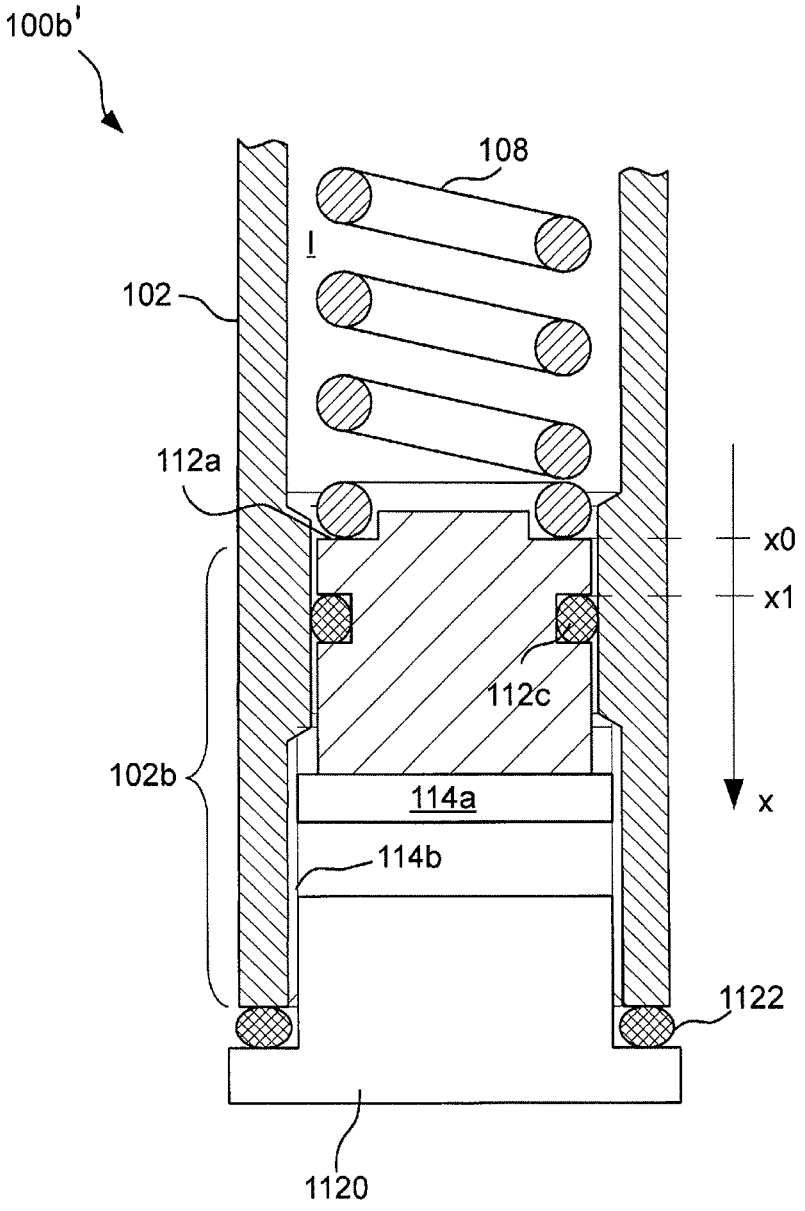

FIG. 4*a* shows schematically an aspect of a further embodiment 100*b*' of the drive device according to the invention. For the sake of clarity, only the part of housing 102 is depicted which accommodates adjustment device 114. In addition to adjustment device 114 and (primary) sealing element 112, see also FIG. 2*a*, a secondary sealing element 1120 is provided in drive device 100*b*' according to FIG. 4*a*, which seals the interior space I of housing 102 against opening 102*a* (FIG. 2*a*), in particular independently of the primary sealing element 112 and/or independently of any state of primary sealing element 112. In the present case, secondary sealing element 1120 is provided with an external thread which cooperates with the internal thread 114*b* of portion 102*b*, so that the secondary sealing element 1120 can be screwed into or out of housing 102. The secondary sealing element 1120 in this case has, in its lower area in FIG. 4*a*, a flange-like widening which carries a second seal ring 1122, which, upon screwing the secondary sealing element 1120 into the housing 102 is pressed against housing 102 and thus contributes to the sealing of interior space I. This results in an in-series connection of the two sealing elements 112, 1120 between interior space I and the surroundings. Overall, the secondary sealing element 1120 has, for example, a substantially T-shaped cross-section.

In a further embodiment, the secondary sealing element 1120 can also have a stuffing box.

In a further embodiment, housing portion 102*b* can also have, for example, a flange (not shown) in its lower area in FIG. 4*a*, on which a sealing ring comparable to component 1122 is arranged. In this case, the secondary sealing element can be formed, for example, by a substantially disc-shaped body which can be attached to the flange (in particular can be screwed on or clamped) and in this way is held sealingly against seal ring 1122 relative to housing 102.

Figure 4B:
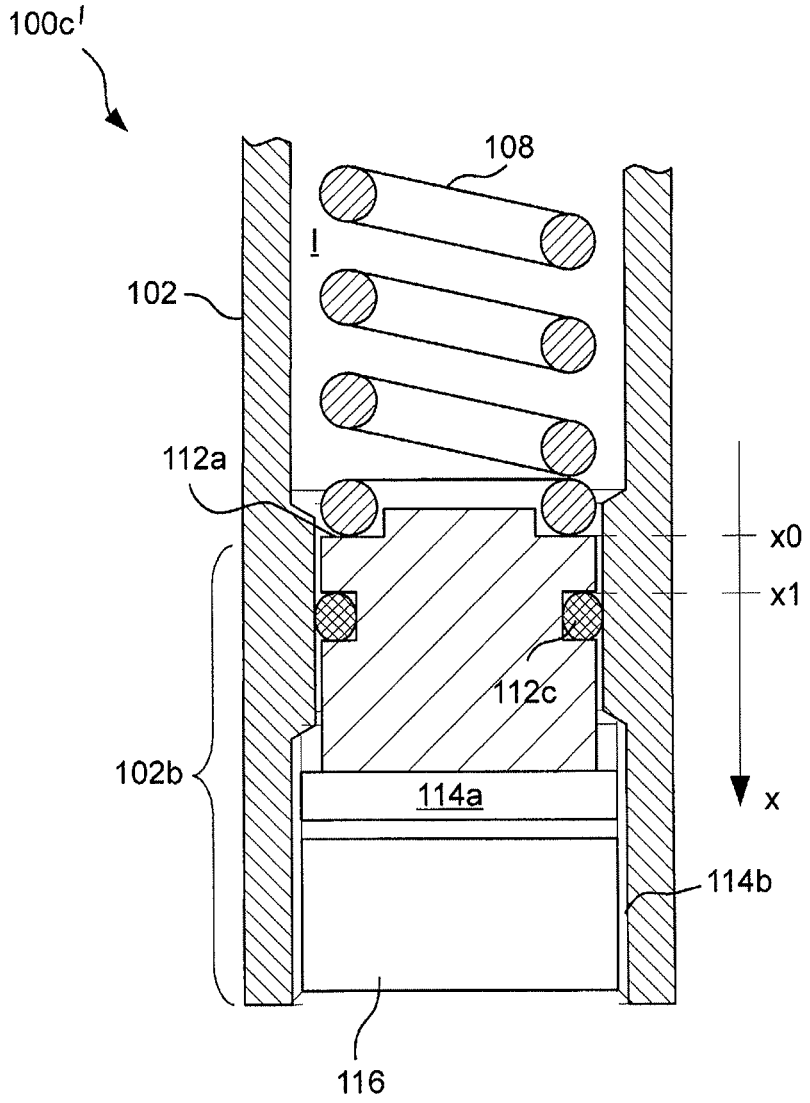

FIG. 4*b* schematically shows an aspect of a further embodiment 100*c*' of drive device according to the invention. Again, for the sake of clarity, only the part of housing 102 is depicted, which accommodates adjustment device 114. Here a securing element 116 is provided, which is configured for locking adjustment device 114, whereby undesirable adjustment of adjustment device 114 is avoided, as may occur, for example, by vibrations and/or temperature changes. In the present case, securing element 116 is configured as a counter screw with an outer thread (not shown) matching the inner thread 114*b* and can be screwed tight by screwing it into the housing portion 102*b* against adjustment device 114 for locking adjustment device 114. FIG. 4*b* shows a state in which the counter screw 116 does not already have contact with adjustment element 114*a*.

What is claimed is:

1. A drive device for an electrical switching device for a high-voltage switch, having a housing which can be filled with insulating gas and which includes an interior space and an exterior, having an energy storage device which is arranged in the housing and has a spring and a stop against which the spring can be tensioned; characterized in that an adjustment device, which can be actuated from the exterior of the housing is provided, by means of which a position of said stop in said housing can be adjusted along an axis.

2. The drive device according to claim 1, wherein said housing has an opening, and wherein an adjustment element of said adjustment device, which can be coupled to said stop, is movably arranged in said opening, parallel to or along the axis.

3. The drive device according to claim 2, wherein said housing has a guide for the adjustment element adjacent said opening.

4. The drive device according to claim 2, wherein the housing has an internal thread adjacent said opening, and wherein the adjustment element has an external thread cooperating with said internal thread.

5. The drive device according to claim 2, wherein a sealing element is provided which seals an interior space of said housing against said opening, wherein the sealing element is associated with at least one ring seal and at least one lip seal ring.

6. The drive device according to claim 5, wherein said stop is arranged on an end face of said sealing element facing said interior space.

7. The drive device according to claim 5, wherein said sealing element can be coupled to said adjustment element on its end face facing away from the interior space.

8. The drive device according to claim 5, wherein said sealing element is formed integrally with the adjustment element.

9. The drive device according to claim 2, wherein said adjustment element has a driving profile on its side facing away from said interior space of said housing.

10. The drive device according to claim 2, wherein a secondary sealing element is provided which seals said interior space of said housing against said opening independently of said sealing element or independently of a state of said sealing element.

11. The drive device according to claim 2, wherein a securing element is provided, which is configured for locking said adjustment device.

12. The drive device according to claim 1, wherein said housing has a hollow cylindrical portion, and wherein the adjustment device and at least a portion of the spring is arranged in said hollow cylindrical portion.

13. The drive device according to claim 12 wherein a ratio of an outer diameter of said hollow cylindrical portion to an outer diameter of said spring is between about 110 percent and about 200 percent.

14. The drive device according to claim 1, wherein said spring at its end section facing away from said stop is coupled to a first lever arm of a lever rotatably mounted in said housing by means of a spring plate which is arranged rotatably on said lever.

15. The drive device according to claim 14, wherein a second lever arm of said lever is coupled to a drive rod for actuating a switching contact of said switching device.

16. The drive device according to claim 1, wherein said housing contains at least one insulating gas of the following group: sulfur hexafluoride, tetrafluoromethane, carbon dioxide, a gas from the group of fluorinated nitriles, wherein said housing preferably contains a mixture of a fluorinated nitrile with carbon dioxide.

17. A switching system comprising: at least one switching device; at least one drive device for the at least one switching device that has a housing which can be filled with insulating gas and includes an exterior; an energy storage device which is arranged in the housing and has a spring and a stop against which the spring can be tensioned; characterized in that an adjustment device, which can be actuated from the exterior of the housing, is provided, by means of which a position of said stop in the housing can be adjusted along an axis.

* * * * *